US006712359B1

(12) United States Patent
Vanlier

(10) Patent No.: US 6,712,359 B1
(45) Date of Patent: Mar. 30, 2004

(54) GAME APPARATUS AND METHOD OF PLAY

(76) Inventor: Kenneth E. Vanlier, 606 Steeplechase, Tuscaloosa, AL (US) 35106

( * ) Notice: Subject to any disclaimer, the term of this patent is extended or adjusted under 35 U.S.C. 154(b) by 0 days.

(21) Appl. No.: 10/409,224

(22) Filed: Apr. 8, 2003

(51) Int. Cl.[7] ..... A63F 3/00

(52) U.S. Cl. ..... 273/237; 273/248; 273/258; 273/287

(58) Field of Search ..... 273/236, 237, 273/238, 258, 287, 284, 248; 463/6, 128; D21/334

(56) References Cited

U.S. PATENT DOCUMENTS 4,182,514 A * 1/1980 Magid et al. ..... 273/237

4,294,448 A * 10/1981 Oler ..... 273/108.41

* cited by examiner

*Primary Examiner*—Vishu K Mendiratta

(74) *Attorney, Agent, or Firm*—Waters & Morse, P.C.

(57) ABSTRACT

A game involving simultaneous moves by opposing players comprises a game board having separate lanes extending in discreet steps from starting positions to ending positions. Player controlled linked gates control movement along the lanes. Players simultaneously select lanes and gate positions and then move through all open gates in the selected lane. Each time a player reaches the ending position, he scores a point and starts over. A predetermined total score wins the game.

10 Claims, 3 Drawing Sheets

GAME APPARATUS AND METHOD OF PLAY

BACKGROUND OF THE INVENTION

The present invention relates to a game apparatus for a board type game and a method of play.

There are a number of board games wherein players advance from starting positions to ending positions along a path containing discreet steps pursuant to the rules of play of the game. In most such games, advancement by each player is alternative and sequential, that is, the players take turns, one player going first and the next player following. Where the players alternate moves, an object of the game for each player is to determine how an opposing player will move in response to the player's current move.

An object of the present invention is to provide a game apparatus and a method of play for a game wherein players' moves are simultaneous, and playing decisions involve predicting another player's unknown simultaneous move.

SUMMARY OF THE INVENTION

In accordance with the present invention, a game for at least two persons comprises a game board having two separate lanes, each lane extending though a discreet number of sites between starting and ending positions. A movable gate is positioned between adjacent sites in each lane, the gates between corresponding sites in adjacent lanes being interdependent, such that when a gate in one lane is open, a corresponding gate between sites in the other lane is closed, both corresponding gates changing their status simultaneously when one of the corresponding gates is open or closed. A control mechanism permits each player to change the status of every other gate along a lane, such that one player controls the first and third sequential gates in a lane and the other player controls the second and fourth sequential gates in a lane, and so forth. Game pieces mark the position of each player as the player advances from his starting position to his ending position, each player scoring a point when his game piece reaches the player's ending position. A manual or electronic playing mechanism permits each player to choose, simultaneously and in confidence for each move, a lane in which-to position his game piece and a gate to open or close if desired. The players' choices are revealed simultaneously after each move is selected by both players. Any playing pieces thereafter positioned adjacent one or more open gates in his lane moves through the open gates until either the ending position or a closed gate is encountered, at which position the game piece stops. A score is achieved each time a game piece reaches its ending position. The player then repositions his game piece at the player's starting position and starts over. The game proceeds continuously until a winning score is achieved by one of the players.

Desirably, the game board is divided into three adjacent zones, a zone for a first player, a zone for a second player, and a neutral zone positioned between the player zones, each player having its starting position in that player's zone, each lane extending through both player zones and the neutral zone. In playing the game, collisions between game pieces occur when two game pieces either attempt to move through the same gate or move to the same site in the same move. A collision is resolved in favor of the player in whose zone the collision occurs, the game piece of that player advancing to the site that the player had chosen in his move, the game piece of the opposing player being returned to its starting position to start over. When a collision occurs in the neutral zone, each player returns his game piece to his starting position.

The game can be implemented with a mechanical game board or electronically. When the game is implemented electronically, the game board and player positions are depicted on an electronically operated display screen. Each player's moves, reflecting game piece lane changes and gate position decisions, are recordable independently by electronic input devices to an electronic control device. The electronic control device stores each player's moves in confidence until both players have moved or a designated time period for moving has elapsed, at which time the control device displays both players' moves on an electronic display. The electronic implementation may be achieved by a stand alone electronic game board having confidential electronic input means for each player, a playing field and electronic move display screen. Alternatively, the electronic implementation can be achieved by one or more computers, wherein a computer input device is used to select player moves, and a computer display screen is used to display the playing board and player moves. The game also can be implemented by multiple computers connected in a network.

These and other features of the present invention are described in detail below and shown in the appended drawings

DETAILED DESCRIPTION OF PREFERRED EMBODIMENT

Figure 2:
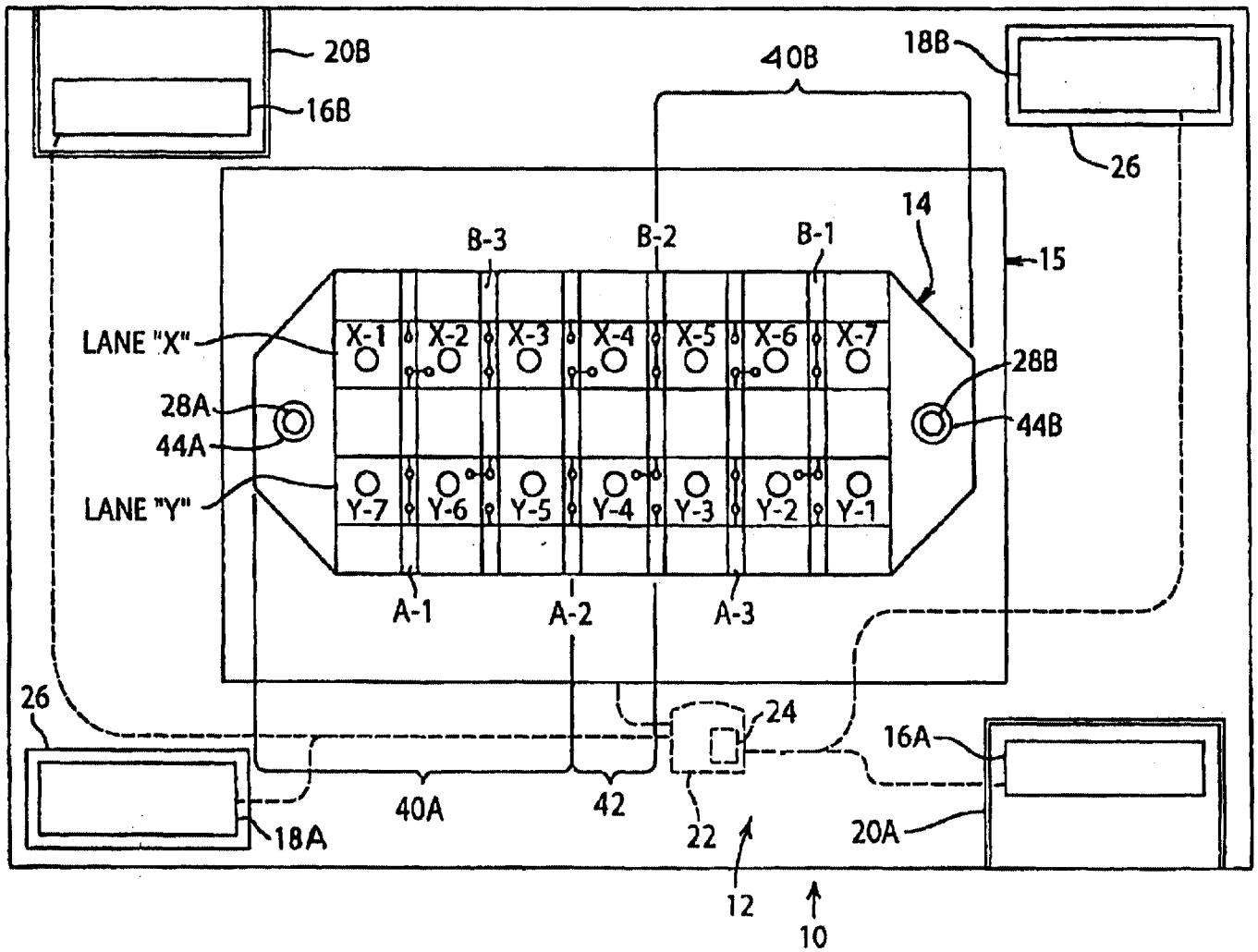
FIG. 2 is a plan view of an electronic game board for playing of the game of the present invention.

Referring now to the drawings, the game of the present invention is most easily described in connection with the game board layout shown in FIG. 2, which is an electronic configuration of the game. A free standing game is illustrated in FIG. 2, but the game also can be implemented by means of a computer, with the game being played by one player against a computer player with a single computer, or multiple players could play on a single computer, or multiple players could play on multiple computers by means of a network or the internet. A computer implemented game is illustrated schematically in FIG. 3.

Referring to FIG. 2, game 10 comprises a base 12 on which a playing field 14 is positioned. The field can be printed on the board or displayed on an electronic or video display 15.

The exemplary game is intended to be played by two players (designated "A" and "B"), but the game could be adapted to be played by more players. The game apparatus also includes recording or input devices 16A and 16B for recording the game moves, respectively, of players A and B. The apparatus also includes display or output devices 18A and 18B for simultaneously displaying the selected moves of players A and B. The moves of each player can be mechanically shielded by fences 20A and 20B positioned adjacent each recording or input device, or the moves can be otherwise shielded. In an electronic version of the game, a control unit 22, which can be a computer central processing unit, can be connected to the display and recording devices of both players and programmed so that the display devices do not disclose one player's move until both players have made their moves, at which time the moves are disclosed simultaneously. As an alternative to the computer-controlled simultaneous display of moves, mechanical covers 26 (shown in phantom) can be placed over the display screens and exposed simultaneously by the players. The computer can include a timer 24 that limits each player's move to a specific amount of time. The timer can be set so that a player who fails to select a move within the time limit does not move his man or any gate for that move.

The playing field provides spaced starting positions 28A and 28B and ending positions for game pieces 44A and 44B for at least two players, the respective starting positions being spaced on opposite sides of the playing field. The playing field has at least two paths or lanes X and Y leading from each starting position to each ending position, with each path being divided into discreet steps or sites X1 to X7 Y1 to Y7. The ending position for each lane is the site at the end of the lane. The lanes also can be identified by colors, as by pink for the X lane and blue for the Y lane. Desirably, the lanes are parallel and the sites of one lane are adjacent to the sites of the next lane. In the preferred practice of the present invention, there are seven sites or positions in each lane, leading from the starting position to the ending position.

The positions in each lane are separated by alternative barriers A1–3 and B1–3, with each barrier having a gate in each lane. The gates can open or close. Each player controls three barriers along the lanes, with the players controlling every other barrier along the lanes. Adjacent gates in adjacent lanes are linked together, such that when the gate in one lane is opened, the linked gate in the adjacent lane is automatically closed, and vice versa. Thus, when player A closes the gate at one barrier in one lane, the gate in the barrier in the adjacent lane is opened.

The playing field includes three zones, a separate zone 40A and 40B for each player at opposite ends of the playing field and a neutral zone 42 between the separate zones for each player. The lanes or paths extend through all three zones in going from the starting position to the ending position. Action that occurs in each player's zone favors that player, as will be described below.

The object of the game for each player is to move his game piece or man 44A or 44B from his starting or base position along the lanes to the ending position in a series of simultaneous moves. Each time a player reaches an ending position (Y7 or X1 at one end of the playing field, or Y1 or X7 at the other end), the player scores a point and returns to his starting position to start over. The player with the most points wins at the end of the game.

The manner in which the players progress across a board is as follows. Each player starts with his man 44A or 44B in its base or starting position 28A or 28B, with the players sitting across the board from each other so that each player's man moves from left to right across the board. For each move, each player can determine which of the two lanes X or Y in which he wants to position his man. Thus, player A, starting the game, may elect to place his man in position X1 (the seven positions or steps of the board being numbered according to lane designation), and he confidentially marks this information in his recording device. The players also can choose to move (or not to move) the gates in one of their barriers to a different position on each move. Initially, all of player A gates on one lane (such as lane X) are open and all of the linked gates in lane Y are closed. Conversely, all of these gates of player B in lane X are closed, and the linked gates in lane Y are open. Thus, every other gate in each lane is open at the beginning of the game. For each move, each player can select one gate to change position, or the player can determine that none of the gates will change position. Thus, for example, at move 1, player A may determine that the gate at position A-1 in lane Y will be open, thus causing the gate in lane X at position A-1 to be closed. This information is recorded confidentially in player A's recording device.

Player B does likewise, recording the same information in his recording device. A timer 24 can be employed in order to require that each move be completed in a predetermined period of time, if desired.

After the players have completed their moves, the moves of each player are revealed simultaneously to the other player, and the players and gates are moved, if possible. If a player finds that his man is positioned opposite an open gate in the lane he has selected, his man automatically moves through the open gate into the next position or site along the lane. If the gate adjacent that new position also is open, the player moves his man through that gate, and so forth until the man is adjacent a closed gate. After each player has moved, the players make another confidential move, determining the gate position of one gate and its linked companion and determining the lane in which he wants his man to be located. Since the moves are revealed simultaneously, each player tries to figure out what the other player is thinking when he selects his move, so that his man will be positioned opposite an open gate and will progress along the lane toward the ending position.

Each time a man reaches an ending position, the player receives a point and moves his man back to its starting position to start over. The other player continues along his lane. The players continue to accumulate points until one player tallies a number of points representative of a winning score, and the game is over.

There are special rules applicable to when players collide with each other. This occurs in one of two situations, when two players try to occupy the same site simultaneously or go through opposite sides of the same gate simultaneously. When two players are positioned on opposite sides of the same gate and the gate is open, there is a so-called "transverse" collision between the players. If two players try to move to the same site on the same lane at the same time, a "lateral" collision occurs. The effect of the collision depends upon which of three zones the players are located in when they collide.

As shown in FIG. 2, the playing field is divided into three zones, one zone 40A and 40B at each end for each player and a neutral zone 42 between the two player zones. The zone for each player includes three sites on each lane, while the neutral zone includes one site on each lane. When a collision occurs in one player's zone or in his starting position, that player gets to complete his move, and the other player is returned to his starting position. When two players collide in the neutral zone, both players are returned to their starting positions.

As an alternative method of play, the players can first open and close the gates. The opening and closing of the gates can be accomplished in a separate move from the movement of the men. Thus, the players may first open and close the gates as indicated on the display and then the players may move their men through the gates that are open. As a next step, the men may be moved to the lane indicated on the display.

As an additional alternative method of playing the game, a device may randomly choose between the two alternative ways of playing the game on a move by move basis as the game is being played and then the players may move the men and gates according to which alternative the random device has chosen.

One feature of the present game that differs from most other games is that, rather than a player determining his move in reaction to the move of an opposing player, the player chooses his move based upon his perception of what the other player will do. This can be based on hunch, extra sensory perception, or an analysis of the opposing player's decision making methods.

Figure 3:
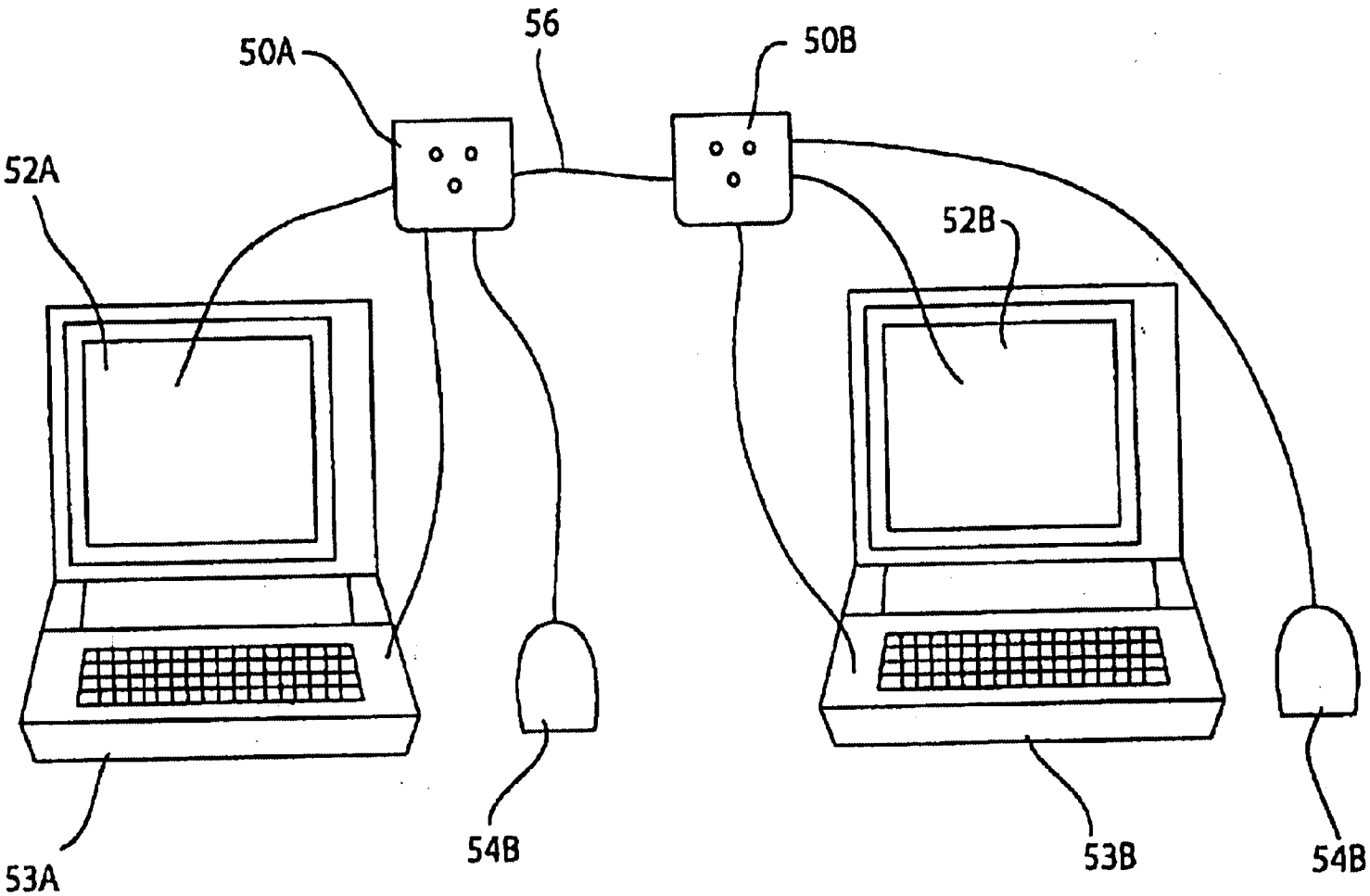
FIG. 3 is a schematic view of a game apparatus for playing the game of the present invention on networked computers.

As illustrated in FIG. 2, the game can be played electronically by a separately existing game board, or as illustrated schematically in FIG. 3, the same game can be played on one or more computers 50A and 50B that are programmed to run the game. The playing field is displayed on each player's monitor 52A and 52B, and each player makes his moves through a keyboard 53A or 53B, a mouse 54A or 54B or other input device. The computers are connected by a local area network, the internet, or other interconnection, shown generally by connector 56. A single computer or multiple computers can be employed to run the game.

Figure 1:
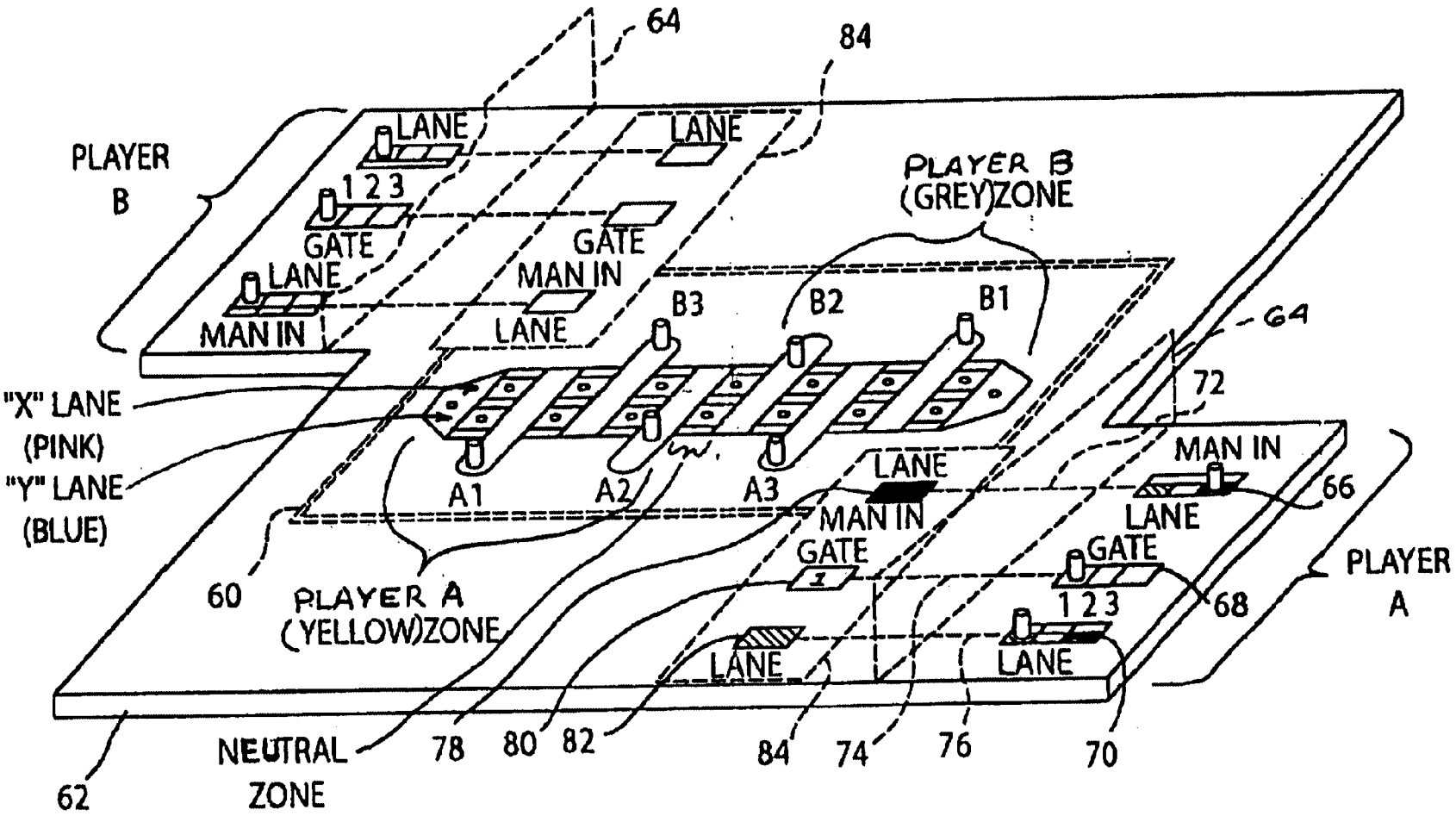
FIG. 1 is a perspective view of a mechanical game board for playing the game of the present invention.

As another alternative, the game can be played in a purely mechanical system in the manner shown in FIG. 1. As shown in FIG. 1, a playing field 60 is laid out at the center of a base 62. Each player has a shield 64 protecting sliding selectors 66, 68, and 70 that reflect the player's choices of lane, gate selection, and gate position. Typically, the devices can be sliding members 72, 74, and 76 that slide between positions reflecting two choices.

The sliding members can be connected through internal chambers in the board to selection display areas 78, 80, 82 covered by movable plates 84. The selection display areas, when the plates are removed, indicate the choice made by each player. With this system, each player selects a lane position for his man, selects a gate barricade number, and selects the lane position of the blocking gate (the other linked gate being open). The play is determined as described above.

It should be understood that the foregoing is merely exemplary of the preferred practice of the present invention and that various changes in the arrangements and details of construction of the embodiments disclosed herein may be made without departing form the spirit and scope of the present invention.

I claim:

1. A game for at least two persons comprising:

a game board having two separate lanes, each lane extending through a discreet number of sites between starting and ending positions;

a movable gate positioned between adjacent sites in each lane, the gates between corresponding sites in adjacent lanes being interdependent, such that when a gate in one lane is open, a corresponding gate between sites in the other lane is closed, both corresponding gates changing their status simultaneously when one of the corresponding gates is opened or closed;

control means for each player to change the status of every other gate along a lane, such that one player controls the first and third sequential gates in a lane and the other player controls the second and fourth sequential gates in a lane, and so forth;

game pieces that mark the position of each player as the player advances from his starting position to his ending position, each player scoring a point when his game piece reaches the player's ending position; and playing means for each player to choose simultaneously and in confidence each move in the game, each move comprising a selection of a lane in which to position the player's game piece and a selection of at least one gate to change the open or closed position thereof, if desired, the player's respective choices being revealed simultaneously after each move is selected by both players, each playing piece thereafter being moved through all open gates in the lane in which the playing piece is located until the playing piece either reaches the ending position in a lane or encounters a closed gate, at which position the game piece stops, a score being achieved each time a game piece reaches its ending position, the player then repositioning his game piece at the player's starting position and starting over after an ending position is reached, the game proceeding continuously until a winning score is achieved by one of the players.

2. A game according to claim 1 wherein the game board is divided into three adjacent zones, a zone for a first player, a zone for a second player, and a neutral zone positioned between the player zones, each player having its starting position in that player's zone, each lane extending through both player zones and the neutral zone.

3. A game according to claim 2 wherein collisions between game pieces occur when two game pieces either attempt to move through the same gate or move to the same site in the same move, the collision being resolved in favor of the player in whose zone the collision occurs, the game piece of the player in whose zone the collision occurs advancing to the site that that player had chosen in his move, the game piece of the opposing player being returned to its starting position to start over.

4. A game according to claim 3 wherein a collision that occurs in the neutral zone is resolved by each player returning his game piece to its starting position.

5. A game according to claim 1 wherein the game is implemented electronically, with the game board and player positions being depicted on an electronically operated display screen, each player's moves reflecting game piece lane changes and gate position decisions being recordable independently by electronic input devices to an electronic control device, the electronic control device storing player moves in confidence until both players have moved or a designated time period for moving has elapsed, the control device thereafter displaying both players' moves on an electronic display.

6. A game according to claim 5 wherein the electronic implementation is achieved by an electronic game board having confidential electronic input means for each player, a playing field, and electronic move display screen.

7. A game according to claim 5 wherein the electronic implementation is achieved by one or more computers wherein one or more computer input devices are used to select player moves, and a computer display screen is used to display the playing board and player moves.

8. A game according to claim 7 wherein the game is implemented by multiple computers connected in a network, each player having his own computer, with each computer having an input device and display screen, the computer being programmed to function as the electronic control device.

9. A method of playing a game of wits comprising:

providing a playing field for at least two players, the playing field having a starting position and an ending position for each player;

providing at least two paths leading from each starting position to each ending position, each path being divided into discreet steps or sites;

providing a game piece or man for each player, the game piece representing the position of each player on the playing field;

providing one or more primary gates between at least some of the sites on a first path, the gates having an open position, wherein a player can move his man from one site through the gate to the site on the other side of the gate, each gate further having a closed position wherein a player cannot move his man from one site to another site through the gate;

providing one or more secondary gates between at least some of the sites in the second path, the secondary gates being linked with corresponding primary gates in the first path such that the open or closed state of a secondary gate is opposite to the corresponding primary gate and such state is changed when the open or closed state of a linked primary gate is changed;

providing player paths between the first and second paths, such that a player can move his man from path to path as well as progress along the first and second paths;

causing each player to start on the starting position for his man;

causing each player to select for each move a proposed lane in which his player is to move and a gate position for one set of linked gates;

displaying the moves for both players simultaneously and thereafter moving the game piece for each player along the lane it occupies until it confronts a closed gate;

continuing play until a man reaches the ending point, and tallying a point for the player; and returning the man to the starting position and continuing play until a player tallies a total number of points representative of a winning score.

10. A method of playing a game comprising:

providing a playing field having spaced starting and ending positions for each player, the playing field further having a pair of separate lanes extending between the starting and ending positions, each lane being subdivided into discreet sites, each site representing a player position, the sites in one lane each having corresponding sites in the other lane, the playing field further having barriers between adjacent sites in each lane, the barriers having gates that may be open or closed, the barriers in one lane each having a corresponding barrier in the other lane, with the barriers being linked such that when a gate in one barrier is open, the linked gate in the other lane is closed, the sites and barrier gates in each lane being sequential and every other sequential barrier gate being controlled by an opposing player;

causing each player to choose in confidence a move comprising selection of a lane for his man and a gate position for one set of linked gates;

displaying the moves of each player to the other player after the other player has selected his move;

moving the man through all open gates in front of his man in the selected lane;

continuing play move by move until a man reaches the ending position;

tallying a point for reaching the ending position; and returning the man to its starting position and continuing play until a player accumulates a total points representative of a winning score.

* * * * *